United States Patent [19]

Miller

[11] Patent Number: 5,022,104

[45] Date of Patent: Jun. 11, 1991

[54] SHOWER CURTAIN SUPPORT

[75] Inventor: Cedric C. Miller, 4439 Pembrook Village Dr., Alexandria, Va. 22309

[73] Assignees: Cedric C. Miller; Janice L. Ferguson, both of Alexandria, Va.

[21] Appl. No.: 560,771

[22] Filed: Jul. 31, 1990

[51] Int. Cl.[5] ..... A47K 3/22

[52] U.S. Cl. ..... 4/558; 4/610; 160/330; 248/251; 248/558; 248/916

[58] Field of Search ..... 4/558, 608–610; 160/330, 341, DIG. 6; 248/251, 558, 916; 403/4

[56] References Cited

U.S. PATENT DOCUMENTS

| | | | |
|---|---|---|---|
| 2,778,030 | 1/1957 | Goche | 4/608 |
| 3,149,811 | 9/1964 | Fremstad et al. | 248/251 |
| 3,418,665 | 12/1968 | Long | 4/610 |
| 4,117,557 | 10/1978 | McPeak et al. | 4/558 X |
| 4,461,056 | 7/1984 | Solinski | 4/610 X |
| 4,754,504 | 7/1988 | Cellini | 4/608 X |

*Primary Examiner*—Charles E. Phillips

*Attorney, Agent, or Firm*—Walter F. Wessendorf, Jr.

[57] ABSTRACT

A shower curtain support has a shower curtain rod mounted by opposing wall brackets on parallel end walls of a shower stall. The rod slidably suspends a conventional shower curtain across the front opening of the shower stall. Spiders on the terminal ends of the rod are indexably received by spider plates of the wall brackets to dispose the rod in a number of radial orientations relative to the wall brackets. In another embodiment for infinite radial orientations of the rod within the full range of 360°, outturned flanges on the rod ends, sandwiched between inturned flanges of compression nuts and closed ends of threaded studs projecting from wall brackets, allow such infinite radial orientations of the rod relative to the wall brackets.

2 Claims, 3 Drawing Sheets

SHOWER CURTAIN SUPPORT

BACKGROUND OF THE INVENTION

1. Technical Field

This invention relates to a shower curtain support for slidably mounting a shower curtain in suspending relationship.

2. Background

A conventional shower curtain rod slidably mounts a shower curtain in suspending relationship. Since bath shower stalls and bathtub enclosures used as shower stalls present similar problems in the art, the terms "shower stall" or "stall", as used herein and in the claims, mean any area adaptable for showering notwithstanding the fact that the same area may be used for other purposes such as bathing. A conventional shower curtain rod even when its shower curtain is closed does not seal the parallel end walls of the shower stall opening because there remains gaps between the lateral sides of such closed shower curtain and their immediate lateral sides of the parallel end walls. Hence, shower water sprays and leaks through such gaps and onto the bathroom floor causing consequent water damage to the bathroom floor and walls. To attempt to prevent such water damage requires continuous attempts to effect complete water cleanups after showering. Hence, there is need for a shower curtain support for slidably suspending a conventional shower curtain across a shower stall opening and which is adjustable radially at the option of the homeowner to meet the needs of such homeowner to have the lateral sides of the conventional shower curtain seal in mating relationship the lateral sides of the parallel end walls of the shower stall opening against shower water spraying and leaking onto the bathroom floor.

SUMMARY OF THE INVENTION

Accordingly, the objects of the invention are to contribute to the solution of the discussed problems of the art by providing brackets, mountable on the parallel end walls of the shower stall opening, that mount a shower curtain rod that slidably suspends a conventional shower curtain across the shower stall opening and that is adjustable to different radial orientations relative to the mounting brackets such that the closed shower curtain can be tailored to seal in mating relationship the lateral sides of the parallel end walls to prevent shower water from spraying and leaking onto the bathroom floor.

BRIEF DESCRIPTION OF THE DRAWINGS

These objects and other objects of the invention should be discerned and appreciated by reference to the detailed description of the preferred embodiment, taken in conjunction with the drawings, wherein like reference numerals refer to similar parts throughout the several drawing figures, in which.

DETAILED DESCRIPTION OF THE PREFERRED EMBODIMENT

Figure 1:
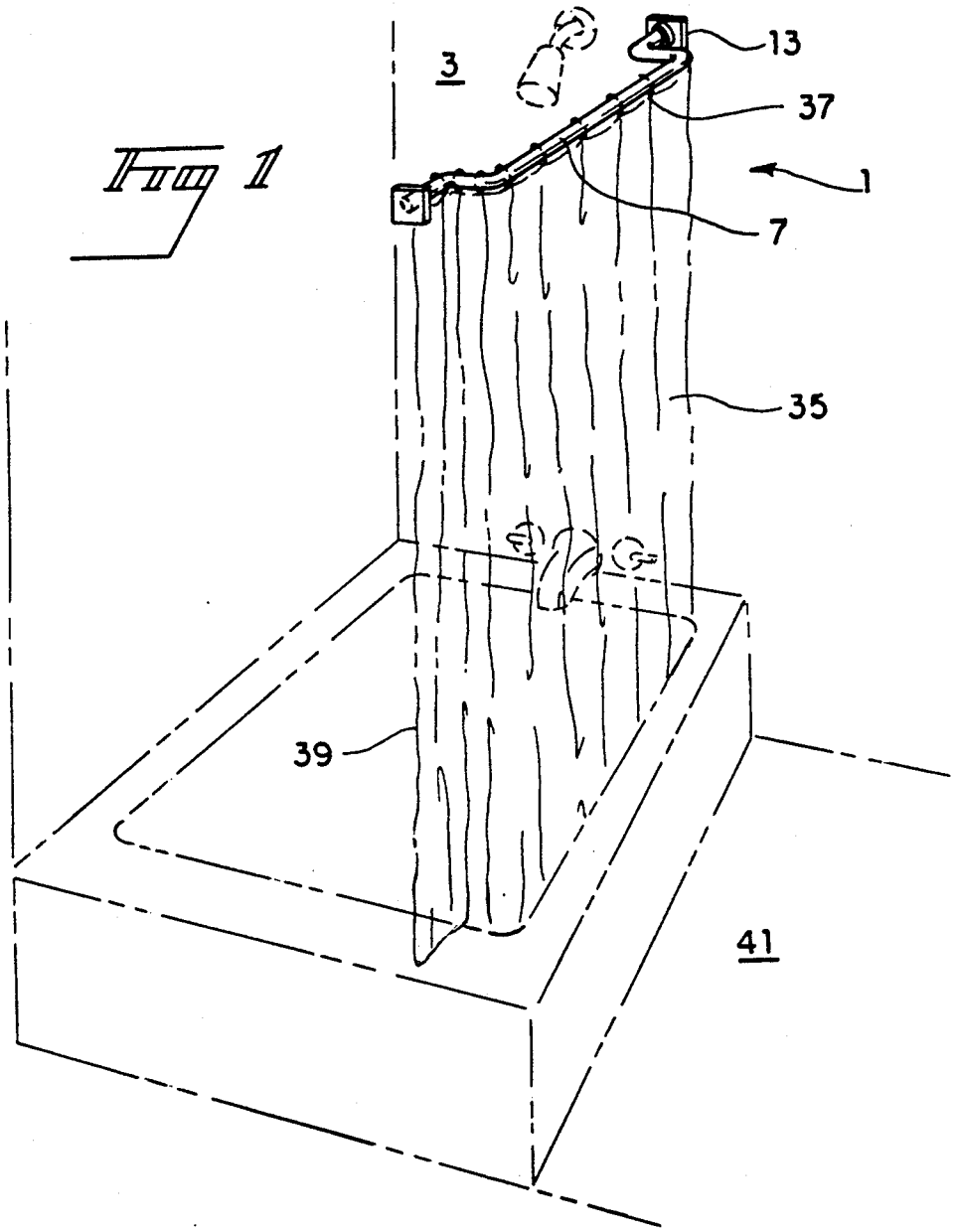
FIG. 1 is a perspective view showing the shower curtain rod of the shower curtain support mounted in one of its positions of radial orientation in a shower stall.
Figure 2:
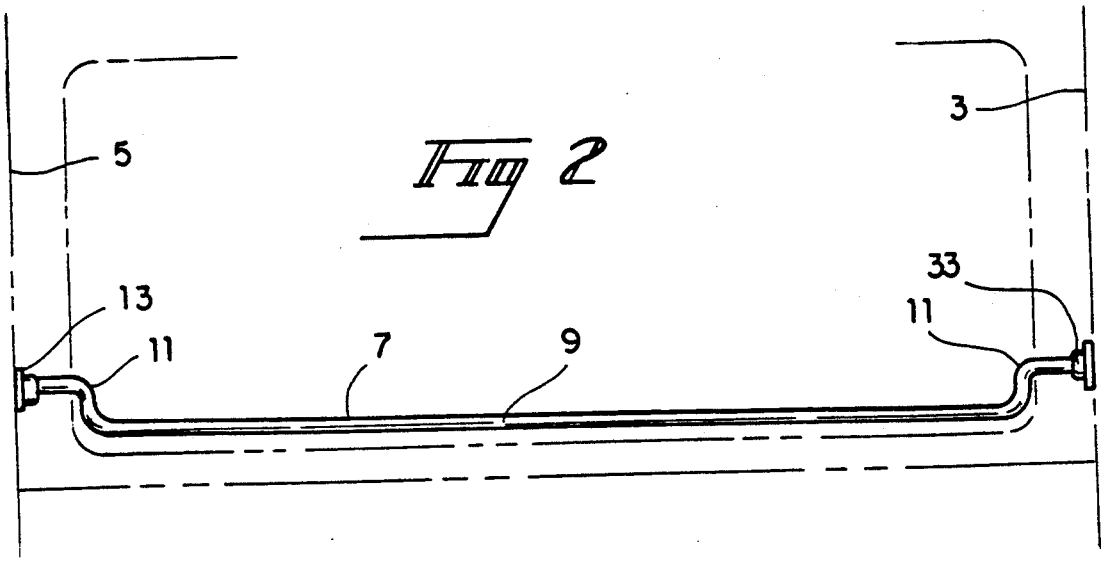
FIG. 2 is a top plan view of FIG. 1.
Figure 3:
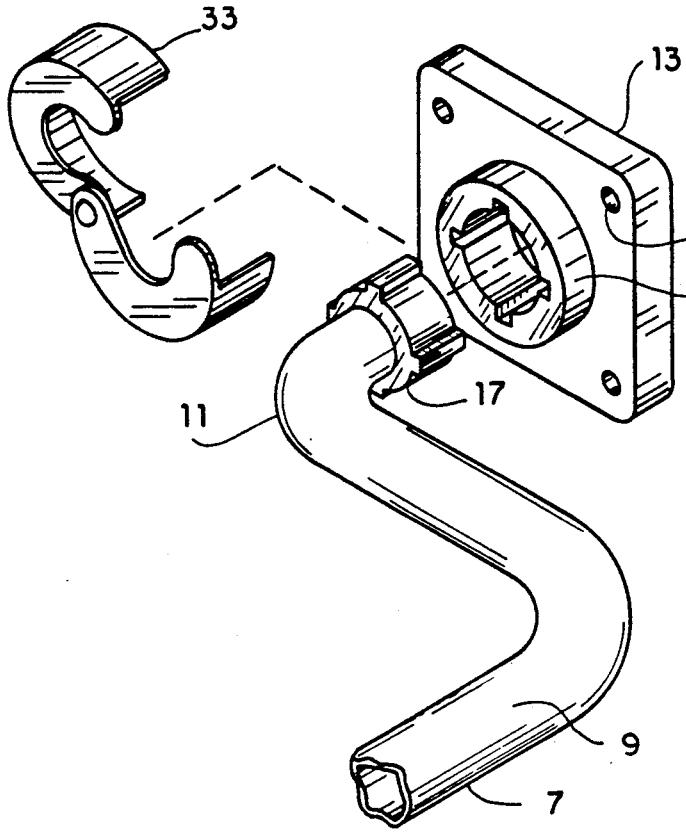
FIG. 3 is an assembly view, in perspective, of one end of the shower curtain rod, a wall bracket and escutheon.
Figure 4:
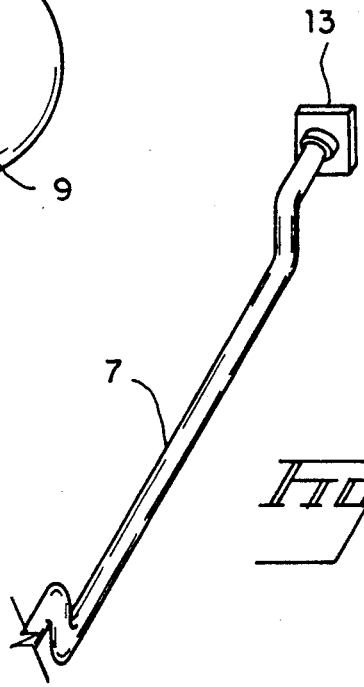
FIG. 4 is a perspective view of the shower curtain rod in a different position of radial orientation.
Figure 5:
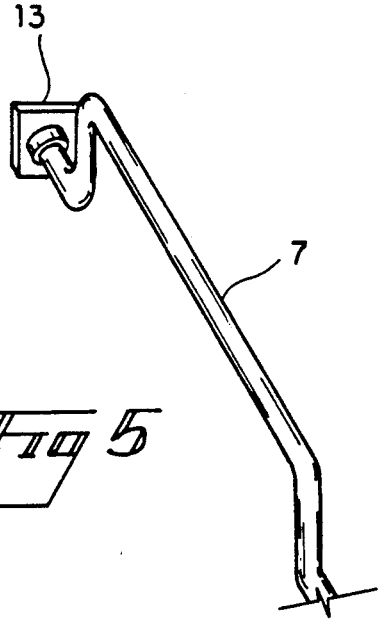
FIG. 5 is a perspective view of the shower curtain rod in another position of radial orientation.
Figure 6:
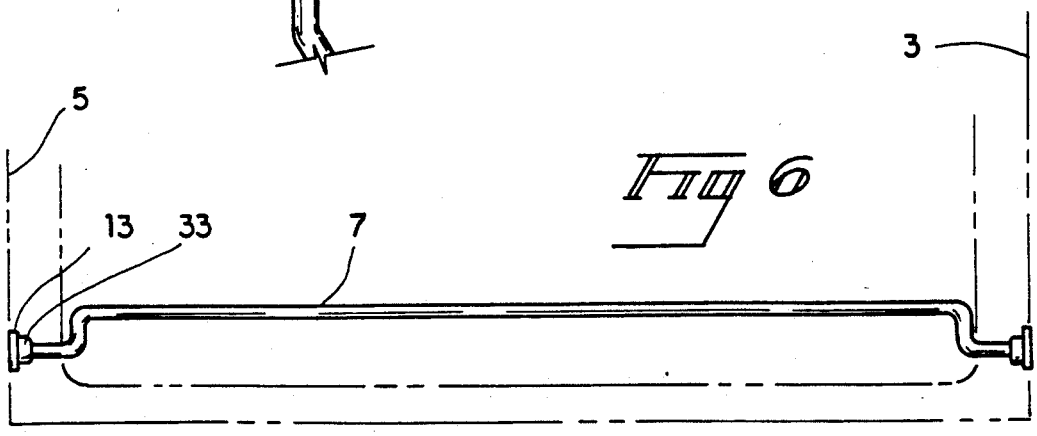
FIG. 6 is a top plan view of the shower curtain rod in another position of radial orientation.
Figure 7:
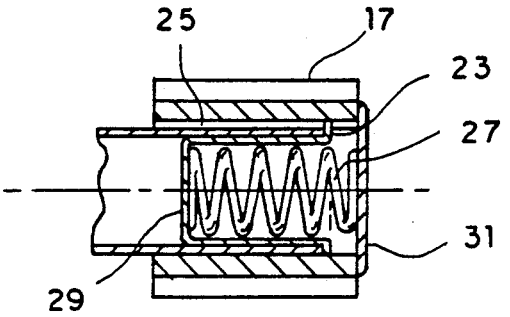
FIG. 7 is an assembly view, in section, of the spring-biased spider carried on the end of the shower curtain rod.
Figure 8:
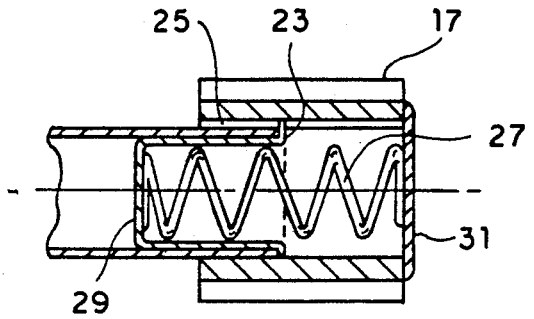
FIG. 8 is an assembly view, in section, showing spatial accommodation of the shower curtain rod to a greater length than shown in FIG. 7.
Figure 9:
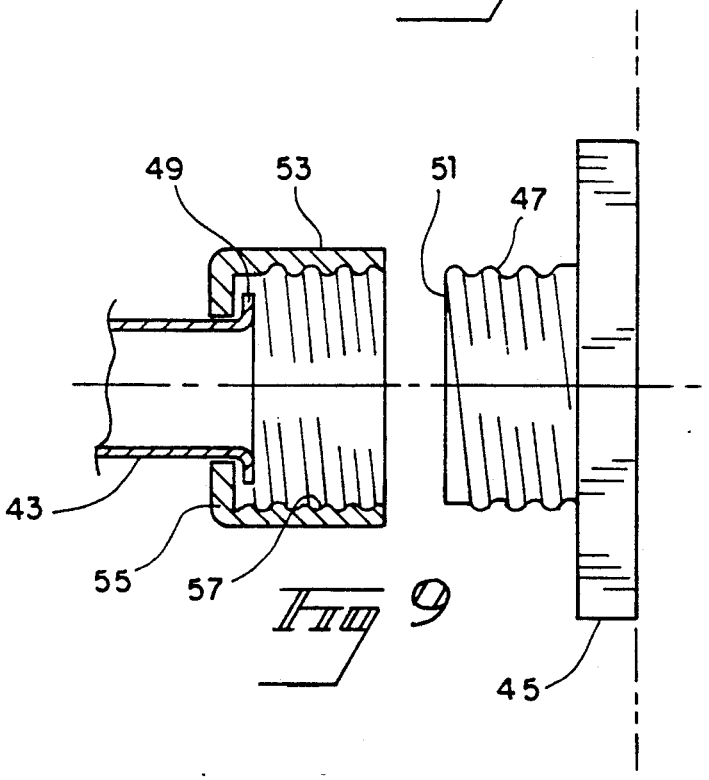
FIG. 9 is an assembly view, partly in section, of an embodiment for assembly of the end of the shower curtain rod with its wall mounting bracket to afford infinite radial orientation of the shower curtain rod.

In FIG. 1 of the drawings, reference numeral 1 generally refers to the invention of the shower curtain support. Shower curtain support 1 is mounted across the front opening of the shower stall defined by its opposing parallel end walls 3 and 5. Shower curtain support 1 has a shower curtain rod 7, of integral, one-piece construction, that has a rectilinear, straight pipe main body portion 9 that terminates in similar S-shaped ends 11 having the same orientation. Shower curtain rod 7 is supported by opposing wall brackets 13 fixed to the end walls 3 and 5 either by an adhesive layer (not shown) sandwiched between each of the wall brackets 13 and its respective end wall 3 or 5, or by mounting screws (not shown) disposed through holes 15 in wall brackets 13 and fixedly engaged with end walls 3 and 5. The terminal end portions of S-shaped ends fixedly carry spiders 17 complementally received in spider plates 19 of wall brackets 13. As shown in FIGS. 7 and 8, each of the S-shaped ends 11 fixedly mounts a closed end tube 21 having an upstanding key 23 received in a keyway 25 formed in spider 17, such that spider 17 is reciprocable longitudinally only and whose rotation is prevented by key 23 engaged with keyway 25. A compression spring 27 is trained between the closed end 29 of tube 21 and the closed end 31 of spider 17. Appropriate compression of springs 27 allows the spiders 17 to be lockingly engaged in spider plates 19 and released with the restoring force of compression springs 27 effecting rigid mounting of shower curtain rod 7 with the wall brackets 13 and concomitantly accommodating spatial necessity dictated by the differences in dimensional lengths between the parallel end walls 3 and 5. Upon completion of such described installation of the shower curtain rod 7, the spiders 17 and spider plates 19 are covered by escutcheons 33. Thereafter, a conventional shower curtain 35 is slidably mounted in suspending relationship on the shower curtain rod 7 by means of conventional shower curtain fasteners 37. The spiders 17 and spider plates 19 allow the shower curtain rod 7 to be indexably disposed in four discrete positions of radial orientation relative to the brackets 13. In the position shown in FIGS. 1 and 2, the spiders 17 are appropriately oriented and engaged with spider plates 19 so that the main body portion 9 of the shower curtain rod 7 is disposed horizontally outward. In such position, the lateral sides 39 of the closed shower curtain 35 will seal the end walls 3 and 5 to prevent shower water from spraying and leaking onto the bathroom floor 41. In the position shown in FIG. 4, the spiders 17 are appropriately oriented and engaged with spider plates 19 so that the main body portion 9 of the shower curtain rod 7 is disposed vertically downward. This position would be beneficial to correct the problem where either a shower curtain is too short in length; or where a conventional shower curtain rod was originally installed too high. In both situations, the shower curtain is too high off the floor of the shower stall with consequent spraying and leakage of shower water beneath the shower curtain and onto the bathroom floor 41. In both situations, to lower the conventional shower curtain rod to correct the problem would require the conventional wall brackets that were installed to be lowered and which may result in substantial damage to the end walls. In these two situations, the brackets 13 can be installed in the same places where the original brackets were installed and with the main body portion 9 disposed vertically downward to correct the problem by likewise lowering the shower curtain. In the position shown in FIG. 5, the spiders 17 are appropriately oriented and engaged with spider plates 19 so that the main body portion 9 of the shower curtain rod 7 is disposed vertically upward. In such position, the lateral sides 39 of the closed shower curtain 35 will seal the end walls 3 and 5 to prevent shower water from spraying and leaking onto the bathroom floor 41. In addition, the S-shaped ends 11 of the shower curtain rod 7 function as "gravity locks" to maintain the lateral sides 39 of the closed shower curtain 35 in sealing relationship against the end walls 3 and 5. This position could also be utilized to correct the problem of brackets originally installed too low with respect to the floor of the shower stall with the consequent result that the originally installed shower curtain drags on the floor of the shower stall. In the position shown in FIG. 6, the spiders 17 are appropriately oriented and engaged with spider plates 19 so that the main body portion 9 of the shower curtain rod 7 is disposed horizontally inward. In such position, the lateral sides 39 of the closed shower curtain 35 will likewise seal the end walls 3 and 5 to prevent shower water from spraying and leaking onto the bathroom floor 41. In FIG. 9 is shown structure for effecting adjustable disposition of shower curtain rod 43 in an infinite number of radial orientations relative to the wall brackets 45. The opposing wall brackets 45 are fixed to opposing end walls 3 and 5 similarly as wall brackets 13 may be fixed. Fixed to and transversely projecting horizontally from wall brackets 45 are closed-end, male-threaded portions or studs 47. Shower curtain rod 43 has the same configuration as shower curtain rod 7 with the exception that their terminal end 49 are formed as outturned flanges. Such terminal ends 49 must be either the same dimensional length, or slightly less, as the distance between the opposing flat closed ends 51 of the projecting studs 47 of the mounted wall brackets 45. The terminal ends 49 also freely carry opposed compression nuts 53 that have inturned flanges 55 and female-threaded portions 57. Upon appropriate engagement of the female-threaded portions 57 of compression nuts 53 with the male-threaded studs 47 of wall brackets 45, and tightening of same, the inturned flanges 55 of compression nuts 53, outturned flanges 49 of shower curtain rod 43 and the closed ends 51 of the male-threaded portions 47 will be rendered in locking engagement with the shower curtain rod 43 disposed in a discrete position of radial orientation relative to wall brackets 45. Such feature of infinite adjustability, for example, would allow the shower curtain rod 43 to be disposed not only vertically upward, as the shower curtain rod 7 is so shown to be disposed in FIG. 5, but also would allow the shower curtain rod to be disposed throughout the full 360° range of infinite radial orientations. For example, so long as the main body portion of the shower curtain rod 43 remains slightly above an imaginary horizontal plane passing through the center line of the projecting studs 47, the S-shaped ends of shower curtain rod 43 will retain their "gravity-lock" features and functions in maintaining the lateral sides 39 of the closed shower curtain 35 in sealing relationship against the end walls 3 and 5 whether the main body portion of shower curtain rod is disposed outwardly or inwardly. In addition, such infinite adjustability afforded for radial orientations of the shower curtain rod 43 within the 360° range would not only allow infinite adjustments for suspended shower curtains 35 to correct the discussed problems of shower curtains 35 that are either too high off the floor of the shower stall to correct such problem, or too low with respect to the floor of the shower stall to correct the problem of a shower curtain 35 dragging on the floor of the shower stall, and to correct the problem of a shower curtain 35 that is not vertically oriented properly in its suspended relationship with respect to the inside of the front wall of a bathtub with this problem being corrected by moving the suspended shower curtain 35 either toward or away from the inside of such front wall of such bathtub.

I claim:

1. A shower curtain support for suspending a conventional shower curtain across a shower stall opening defined by opposed parallel end walls, including:

continuous supporting rod means for integral, one-piece construction, having S-shaped ends, for slidably mounting said shower curtain in suspending relationship, said S-shaped ends having terminal end portions, said terminal end portions of said S-shaped ends carrying spider means for complemental reception by spider plate means for effecting discrete fixed dispositions of said rod means in radially indexed orientations, of four orientations 90° apart, relative to bracket means, said S-shaped ends carrying said spider means in longitudinally reciprocable relationship; and bracket means on said end walls for supporting said rod means, said bracket means having said spider plate means, said spider plate means complementally receiving said spider means carried by said terminal end portions of said S-shaped ends for effecting adjustable fixed dispositions of said rod means in radial indexing orientations, of four orientations 90° apart, relative to said bracket means.

2. A shower curtain support in accordance with claim 1, wherein said terminal end portions of said S-shaped ends and said spider means have cooperating means biasing said spider means in outward longitudinal movement to effect locking engagement of said spider means with said spider plate means of said bracket means and effect rigid mounting of said rod means with said bracket means.

* * * * *